United States Patent [19]

Arlt et al.

[11] Patent Number: 4,956,096

[45] Date of Patent: Sep. 11, 1990

[54] PROCESS FOR REMOVING FROM ELECTROCOATING BATHS IMPURITIES WHICH CAUSE SURFACE DEFECTS

[75] Inventors: Klaus Arlt, Senden; Theodora Dirking, Munster; Karl H. Josten, Munster; Hans J. Streitberger, Munster, all of Fed. Rep. of Germany

[73] Assignee: BASF Lacke & Farben AKT, Munster, Fed. Rep. of Germany

[21] Appl. No.: 384,915

[22] Filed: Jul. 25, 1989

Related U.S. Application Data

[63] Continuation of Ser. No. 74,483, Jun. 29, 1987, abandoned.

[30] Foreign Application Priority Data

Nov. 15, 1985 [DE] Fed. Rep. of Germany ..... 3540575

[51] Int. Cl.[5] ..... B01D 15/00

[52] U.S. Cl. ..... 210/692

[58] Field of Search ..... 210/650, 651, 660, 692, 210/693, 767, 799

[56] References Cited

U.S. PATENT DOCUMENTS 4,336,138 6/1982 Taniyama et al. ..... 210/321.88

*Primary Examiner*—Ivars Cintins

*Attorney, Agent, or Firm*—Kenyon & Kenyon

[57] ABSTRACT

A process for removing from electrocoating baths impurities which cause surface defects.

The invention relates to a process for removing from electrocoating baths impurities which cause surface defects, wherein the electrocoating paint, in addition to the purification operations which are already conventional, is filtered without pressure through an adsorbent which adsorbs hydrophobic substances having a surface tension≦35 mN/m—preferably homopolymers or copolymers of ethylene, propylene, but-1-ene or but-2-ene, which, if appropriate, contain further nonpolar comonomers.

4 Claims, No Drawings

PROCESS FOR REMOVING FROM ELECTROCOATING BATHS IMPURITIES WHICH CAUSE SURFACE DEFECTS

This application is a continuation of application Ser. No. 074,483, filed June 29, 1987 now abandoned.

The invention relates to a process for removing from electrocoating baths impurities which cause surface defects.

In electrocoating, which has prevailed as a process for automatic coating of bulk materials, water-dilutable dip coatings are deposited using electrical energy. Anodically and cathodically depositable systems are available. The workpiece must accordingly be connected as the anode or the cathode during deposition of the coating.

The present invention is preferably applicable to cathodically depositable coatings. However, it can also be employed in anodically depositable systems.

The process according to the invention is very particularly suitable for removing impurities which cause surface defects from electrocoating paints which contain cationic amine-modified epoxy resins as binders. Coating systems of this type have been published, for example, in the following patent documents: U.S. Patent Specification No. 3,799,854, U.S. Patent Specification No. 3,984,299, U.S. Patent Specification No. 4,031,05, U.S. Patent Specification No. 4,252,703, U.S. Patent Specification No. 4,332,711 and German Patent Specification No. 3,108,073.

It is known that the presence in electrocoating baths of even very small amounts (from ≧1 ppm or, in the case of silicone and perfluorinated compounds, even from ≧1 ppb) of hydrophobic substances with a surface tension ≦35 mN/m (for example deep-drawing greases (employed during shaping of body parts), hydrocarbon oils (for example conveyor chain oil), silicone compounds, perfluorinated compounds . . . ) cause surface defects in the deposited and/or overpainted coatings (the ppm or ppb data relate to parts by weight).

The state of the art includes filtering electrocoating paints under excess pressure through filters with polypropylene inserts. These filtrations serve to mechanically remove contaminating solid particles. The pore size is usually 75 μm. In the individual cases, filters with pore sizes up to 10 μm can be employed over relatively short periods of time. In this case, however, the bath composition must be monitored constantly (cf. technical code of practice "Automotive Paints" of 7/1983 published by BASF F+F).

Nevertheless, it frequently happens in practice that, in spite of the filtration, described above, through filters provided with polypropylene inserts, a large number of surface defects occur in the deposited and/or overpainted coatings.

In such cases, it was hitherto necessary to accept qualitatively low-quality coatings or to completely replace the contaminated coating bath.

The object of the present invention was to develop a process by which electrocoating baths contaminated with substances which cause surface defects can be decontaminated to such an extent that qualitatively satisfactory coatings are obtained.

This object was achieved, according to the invention, in addition to the purification operations which are already conventional, by filtering the electrocoating paint, without pressure, through an adsorbent which adsorbs hydrophobic substances with surface tension ≦35 mN/m—preferably homopolymers or copolymers of ethylene, propylene, but-1-ene or but-2-ene, which, if appropriate, contain further nonpolar comonomers.

Mixtures of adsorbents can also be used.

The adsorbents should be present under the process conditions used as solids having a large adsorption surface area (for example as loose fibers or in another finely divided form).

Very particularly preferably employed as adsorbent is a loose-fiber material comprising fibrous polypropylene. This material is marketed by the 3M Company under the name "3M oil sorbent" (as of 1985).

3M product information states that "3M oil sorbent" can be used in environmental protection and labor protection. In these sectors, it is employed in the form of rollers, veils, cushions, tubes and cloths and serves to adsorb thin oil films and oil slicks on bodies of water, pools and puddles, and for removing dangerous liquid work materials which are spilt, for example, during storage, filling or transport.

Technical codes of practice do not mention any use according to the invention of the "3M oil sorbent" material.

In all cases in which the use of "3M oil sorbent" material for decontamination of aqueous systems is described in company publications, systems are always present which comprise separate aqueous and hydrophobic phases. In contrast, the hydrophobic substances which cause surface defects and which are to be removed are homogeneously distributed in the electrocoating paints in a very low concentration (ppb or ppm region).

Surprisingly, the impurities which cause surface defects and which are present in very low concentrations can be removed from the electrocoating paints with the aid of filtration, without pressure, through the adsorbent according to the invention so substantially that they cannot be detected using the analytical methods currently available.

It is furthermore surprising that the electrocoating material, comprising a large number of components and having a complicated composition, can be selectively purified of impurities which cause surface defects, without a disadvantageous change in the coating composition, by filtration, without pressure, through an active adsorbent which has a large adsorption surface area.

Experimental investigations have shown that the process according to the invention has absolutely no effect on the application data for the electrocoating systems treated. Furthermore, it has been possible to show experimentally that no hydrophobic paint components are kept back in the process according to the invention.

In an advantageous embodiment of the invention, filter bags filled with adsorbent are incorporated into the coating circuit of the electrocoating plant so that the additional filtration can easily be included or excluded as required.

The filtration rate can be matched to changing process conditions by varying the volume and number of filter bags employed. The invention is described in greater detail in the following examples. All references to parts and percentages relate to the weight, unless expressly stated otherwise.

EXAMPLE 1

An electrocoating bath (capacity: 360 $m^3$ of electrocoating paint based on a cationic amine-modified epoxy-resin binder) contaminated with a triglyceride made from glycerol, oleic acid, stearic acid and palmitic acid and an anion-active emulsifier, was filtered through 12 filter bags (6 large bags, arranged in parallel, having a volume of 15 to 20 liters, and 6 small bags, arranged in parallel, having a volume of 7 to 10 liters and filled with 750 to 1000 or 350 to 500 grams respectively of loose-fiber material: the small and large bags are arranged in series) filled with loose-fiber material comprising fibrous polypropylene. The filtration rate was 3.6 $m^3$ per hour and the filters were changed every 8 hours.

Even after a filtration time of only 32 hours, it was possible to reduce the number of pits per unit area by 50%.

EXAMPLE 2

5 liters of an electrocoating bath based on a cationic amine-modified epoxy-resin binder were contaminated with 30 ppm of a tetrafluoroethylene/tetrafluoropropylene copolymer (Ontropeen ETG-W2 supplied by Reiner Chemische Fabrik GmbH +Co.). After the fluorinated compound had been distributed completely homogeneously in the electrocoating paint, a test element (L-sheet, Bo 132) containing a horizontal surface was coated. A filler applied after the electrodeposited coating and based on a polyester/amino resin system exhibited more than 150 pits per $dm^2$ on the horizontal surface.

The experiment was subsequently carried out again with the difference that the electrocoating paint was filtered without pressure through 10 g of a loose-fiber material comprising fibrous polypropylene before deposition. In this experiment, the filler coating applied only had 2 pits per $dm^2$.

We claim:

1. A process for purifying an electrocoating bath contaminated with hydrophobic substances having a surface tension less than 35 mN/m, comprising passing, without pressure the contaminated electrocoating bath through an adsorbent volume of solid, fiberous or particulate homo or copolymer of ethylene, propylene, but-1-ene or but-2-ene to remove the hydrophobic substances by adsorption onto the solid, fibrous or particulate homo or copolymer.

2. A process according to claim 1 wherein the solid homo or copolymer has an adsorption area of loose fibers.

3. A process according to claim 1 wherein the adsorbent volume comprises bags filled with loose fiberous polypropylene.

4. In a process for filtering an electrocoating paint utilizing an electrocoating bath, an improvement comprising purifying said electrocoating bath to remove any hydrophobic contaminants which have a surface tension of less than 35 mN/m by passing said bath through an adsorbent volume of solid, fibrous or particulate homo or copolymer of ethylene, propylene, but-1-ene or but-2-ene without pressure to adsorb the hydrophobic contaminants on the solid, fibrous or particulate homo or copolymer.

* * * * *